US011303099B2

(12) United States Patent
Saito et al.

(10) Patent No.: US 11,303,099 B2
(45) Date of Patent: Apr. 12, 2022

(54) MATERIAL FOR SPARK PLUG ELECTRODE AND METHOD FOR PRODUCING SAME

(71) Applicant: TANAKA KIKINZOKU KOGYO K.K., Tokyo (JP)

(72) Inventors: Yuya Saito, Isehara (JP); Kunihiro Shima, Isehara (JP); Shinsuke Mano, Isehara (JP)

(73) Assignee: TANAKA KIKINZOKU KOGYO K.K., Tokyo (JP)

( * ) Notice: Subject to any disclaimer, the term of this patent is extended or adjusted under 35 U.S.C. 154(b) by 0 days.

(21) Appl. No.: 17/273,685

(22) PCT Filed: Sep. 6, 2019

(86) PCT No.: PCT/JP2019/035101
§ 371 (c)(1),
(2) Date: Mar. 4, 2021

(87) PCT Pub. No.: WO2020/050392
PCT Pub. Date: Mar. 12, 2020

(65) Prior Publication Data

US 2021/0320480 A1 Oct. 14, 2021

(30) Foreign Application Priority Data

Sep. 7, 2018 (JP) ..... JP2018-167770

(51) Int. Cl.
*H01T 13/39* (2006.01)
*H01T 21/02* (2006.01)

(52) U.S. Cl.
CPC ..... *H01T 13/39* (2013.01); *H01T 21/02* (2013.01)

(58) Field of Classification Search
None
See application file for complete search history.

(56) References Cited

U.S. PATENT DOCUMENTS 5,894,186 A 4/1999 Matsutani et al.

FOREIGN PATENT DOCUMENTS

| | | | |
|---|---|---|---|
| CN | 103138161 | A | 6/2013 |
| EP | 3 306 762 | A1 | 4/2018 |
| JP | H10-22052 | A | 1/1998 |
| JP | H10-22053 | A | 1/1998 |

(Continued)

OTHER PUBLICATIONS

International Searching Authority, "International Search Report," issued in connection with International Patent Application No. PCT/JP2019/035101, dated Oct. 29, 2019.

(Continued)

*Primary Examiner* — Vip Patel
(74) *Attorney, Agent, or Firm* — Foley & Lardner LLP

(57) ABSTRACT

The present invention discloses a spark plug electrode material including a substrate formed of Ir or Ir alloy, and an antioxidant film covering a surface of the substrate. Here, an underlying layer formed of Au is formed on a surface of the substrate formed of Ir or Ir alloy, and on the underlying layer, a Ni film having a thickness of 3.0 μm or more and 8.0 μm or less is formed as an antioxidant film. The Ni film turns into an antioxidant film formed of Ni oxide in an oxidizing atmosphere at 500° C. or higher. Owing to the antioxidant film, the spark plug electrode material of the present invention has an excellent high-temperature oxidation property.

20 Claims, 1 Drawing Sheet

PLATING SOLUTION A
(No. B1)

PLATING SOLUTION B
(No. B2)

(56) References Cited

FOREIGN PATENT DOCUMENTS

| | | | |
|---|---|---|---|
| JP | 2004-031300 | A | 1/2004 |
| JP | 2004-152682 | A | 5/2004 |
| JP | 2008-053018 | A | 3/2008 |
| JP | 2008-248322 | A | 10/2008 |
| JP | 2009-016255 | A | 1/2009 |
| JP | 2011-018612 | A | 1/2011 |
| JP | 2012-133934 | A | 7/2012 |

OTHER PUBLICATIONS

International Searching Authority, "Written Opinion," issued in connection with International Patent Application No. PCT/JP2019/035101, dated Oct. 29, 2019.

European Extended Search Report, dated Sep. 30, 2021, issued in corresponding European Patent Application No. 19858394.0, (7 pages).

PLATING SOLUTION A
(No. B1)
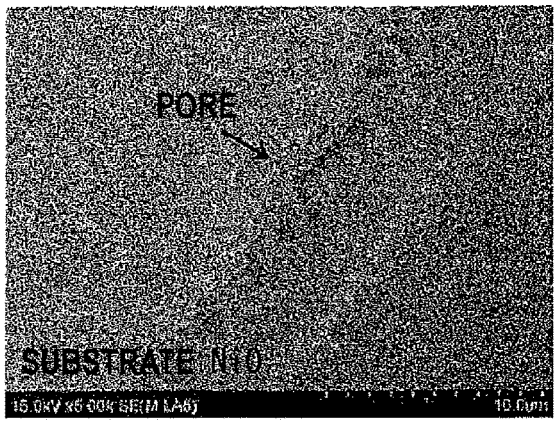
PLATING SOLUTION B
(No. B2)
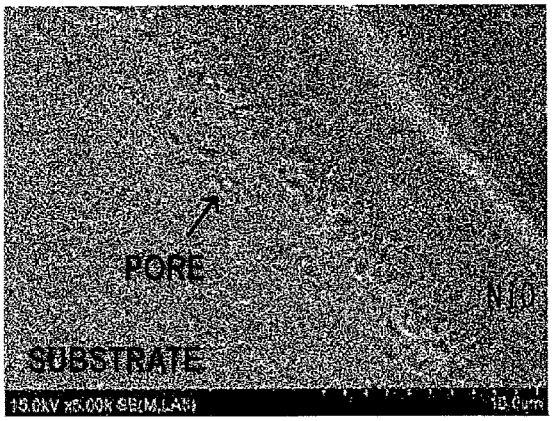

MATERIAL FOR SPARK PLUG ELECTRODE AND METHOD FOR PRODUCING SAME

CROSS-REFERENCE TO RELATED APPLICATIONS

The present application claims priority under 37 U.S.C. § 371 to International Patent Application No. PCT/JP2019/035101, filed Sep. 6, 2019, which claims priority to and the benefit of Japanese Patent Application No. 2018-167770, filed on Sep. 7, 2018. The contents of these applications are hereby incorporated by reference in their entireties.

TECHNICAL FIELD

The present invention relates to a material which is used as a constituent member for a central electrode and/or an earth electrode of a spark plug. The present invention relates particularly to a spark plug electrode containing Ir or Ir alloy as a main constituent material and having an excellent high-temperature oxidation property.

BACKGROUND ART

In recent years, iridium (Ir) plugs have been widely used as spark plugs for automobile engines. An Ir plug can be made to have a thinner electrode shape as compared to a platinum plug, so that good ignition/combustion efficiency is obtained. A chip-shaped member formed of Ir alloy is used as an electrode material for the Ir plug.

Here, as properties required for the spark plug electrode material, a high-temperature oxidation resistance property and spark consumption resistance are considered as being important. That is, development of a material which is less consumed by oxidation even under a high-temperature oxidizing atmosphere and a material which is less spark-consumed by sparks constantly generated during engine operation are considered important.

For spark plug electrode materials formed of Ir alloy, in particularly, improvement of the high-temperature oxidation resistance property is required. This is associated with properties specific to Ir. Specifically, Ir forms IrO at about 600° C., and forms $Ir_2O_3$ at about 900° C. Since these Ir oxides have volatility, so that the Ir alloy may be rapidly consumed in a high-temperature oxidizing atmosphere. It has been heretofore pointed out that Ir plugs have a shorter life as compared to platinum plugs, and this is ascribable to such a high-temperature oxidation resistance property.

Thus, for spark plug electrode materials formed of Ir alloy, there are many cases of studies on improvement of the high-temperature oxidation resistance property. Optimization of the alloy composition of Ir alloy is a common strategy for improvement of the high-temperature oxidation resistance property. For example, a precious metal having a high-temperature oxidation resistance property, such as Pt or Rh, is used as an additive element (Patent Documents 1 and 2), or a base metal such as Cr or Al is added to improve oxidative consumption resistance (Patent Documents 3 to 6).

RELATED ART DOCUMENTS

Patent Documents

Patent Document 1: JP 10-22052 A
Patent Document 2: JP 10-22053 A
Patent Document 3: JP 2008-053018 A
Patent Document 4: JP 2008-248322 A Patent Document 5: JP 2009-016255 A
Patent Document 6: JP 2011-018612 A The material formed of Ir alloy as described above is known as an excellent plug electrode material which has an improved high-temperature oxidation resistance property, and is hardly oxidation-consumed even in a combustion chamber in a high-temperature and high oxidation atmosphere. However, recent automobile engines have a tougher internal environment due to lean combustion for improvement of combustion efficiency, massive EGR combustion systems and high power/high rotation speed/high compression ratio design. Thus, for plug electrode materials, unprecedented improvement of the high-temperature oxidation property is desired.

SUMMARY OF THE INVENTION

Problems to be Solved by the Invention

Accordingly, an object of the present invention is to provide a spark plug electrode material formed of Ir or Ir alloy, which exhibits an excellent high-temperature oxidation property even under a harsh environment as described above.

Means for Solving the Problems

The present invention provides a spark plug electrode material including a substrate formed of Ir or Ir alloy, and an antioxidant film covering a surface of the substrate, the substrate including an underlying layer formed of Au or Au alloy on a surface of the substrate, the antioxidant film being a Ni film having a thickness of 3.0 μm or more and 8.0 μm or less.

In addition, in the present invention, the antioxidant film may be Ni oxide. That is, the present invention provides a spark plug electrode material including a substrate formed of Ir or Ir alloy, and an antioxidant film covering a surface of the substrate, the substrate including an underlying layer formed of Au or Au alloy on a surface of the substrate, the antioxidant film being a Ni oxide film having a thickness of 3.0 μm or more and 8.0 μm or less.

The spark plug electrode material according to the present invention contains as a main component an Ir material being a substrate, and includes an antioxidant film on a surface of the substrate for suppressing oxidation consumption. Many of means for improving the high- temperature oxidation resistance property of an Ir material to be used for spark plug electrodes are based on adjustment of the composition of constituent materials. Such a material change can be said give a fundamental solution for problems, but may have limitations. The present invention is intended to high-temperature oxidation resistance property of the spark plug electrode material by adding an external element that is an antioxidant film for suppressing contact between oxygen and Ir alloy which causes high-temperature oxidation.

Hereinafter, the constitutions of the present invention will be described in detail. As described above, the spark plug electrode material according to the present invention includes a substrate formed of an Ir material and an antioxidant film formed of Ni or Ni oxide.

(A) Substrate

The substrate is formed of Ir or Ir alloy. Ir is pure Ir having a purity of 99.9 mass % or more. In addition, for the Ir alloy, alloy of Ir with at least one of Rh, Ru, Pt, V, W, Cr and Ni as an additive element can be used. The content of Ir in the Ir alloy is preferably 80 mass % or more. Specific forms of the Ir alloy include Ir—Ru alloy (Ru: 5.0 mass % or more and 20.0 mass % or less), Ir—Rh alloy (Rh: 3.0 mass % or more and 30.0 mass % or less) and Ir—Pt alloy (Pt: 3.0 mass % or more and 30.0 mass % or less).

The effect of improving the high-temperature oxidation resistance property by the antioxidant film is remarkably exhibited in a substrate formed of Ir or Ir alloy. This is because as described above, high-temperature oxidation of the Ir material significantly depends on generation of volatile oxides. The antioxidant film has a suppressing action on generation of volatile oxides, and is therefore well compatible with improvement of the high-temperature oxidation property of the Ir material. On the other hand, the effect of the antioxidant film is less significant on precious metals such as Pt than on the Ir material of the present invention because generation of volatile oxides is not a concern.

(B) Antioxidant Film

The antioxidant film is a protective film for suppressing oxidative consumption of a substrate formed of Ir or Ir alloy in an engine atmosphere. That is, the antioxidant film covers a substrate surface to inhibit oxygen from reaching (diffusing to) the substrate surface from the engine atmosphere, so that generation of volatile oxides by the Ir material being a substrate is suppressed. Thus, the antioxidant film is required to hardly allow oxygen to permeate and diffuse through the film at a high temperature. It is necessary that such an oxygen blocking action for Ir which forms volatile oxides.

In the present invention, Ni is used for the antioxidant film. However, Ni itself does not have an oxygen blocking action. Studies conducted by the present inventors revealed that Ni rapidly formed Ni oxide in a high-temperature oxidizing atmosphere which is a use environment, and the Ni oxide exhibited an extremely high oxygen blocking action on the Ir material. This antioxidant film covers the substrate surface without being degraded or worn in a high-temperature oxidizing atmosphere, so that oxidation of the substrate is suppressed. The antioxidant film formed of the Ni oxide film is formed by heating the Ni film in an oxidizing atmosphere at 500° C. or higher. The oxidizing atmosphere is an atmosphere containing oxygen, for example, in the air.

The formation of Ni oxide by oxidation of Ni is irreversible reaction. Thus, in the present invention, when an antioxidant film formed of Ni oxide is temporarily formed, this configuration is maintained even in a state of being free from an oxidizing atmosphere. That is, aspects of the spark plug electrode material of the present invention include those in which an antioxidant film formed of Ni oxide is present. The material having an antioxidant film formed of Ni oxide on the substrate surface can be obtained by using a material with a Ni film as an antioxidant film for the spark plug. In addition, a material with Ni oxide as an antioxidant film can be obtained by performing heat treatment for oxidizing the Ni film before use. The Ni oxide film formed of oxidizing the Ni film is preferably one in a state of Ni oxide (NiO) in terms of a so called stoichiometric composition. However, the state of oxygen deficiency is not completely denied.

The antioxidant film formed of the Ni film or the Ni oxide film has a thickness of 3.0 μm or more and 8.0 μm or less. Even if the antioxidant film has a thickness of less than 1.0 μm, the material has a higher improving effect on the high-temperature oxidation resistance property as compared to a substrate having no antioxidant film. However, this effect is not so high. Studies conducted by the present inventors revealed that by setting the thickness of the antioxidant film to 3.0 μm or more, an improving effect high enough to influence the life of the spark plug was exhibited. On the other hand, the reason why the upper limit of the Ni oxide film is 8.0 μm is that a further improving effect cannot be expected even if a larger thickness is set and that delamination easily occurs if the substrate is thermally expanded at a high temperature. The thickness of the antioxidant film formed of Ni oxide can be measured by observing any cross-section with SEM. Here, it is preferable that an average of values obtained by performing measurement at a plurality of positions. Measurement of the thickness by a gravimetric method is also effective.

It has been confirmed that when the Ni oxide film is used as an antioxidant film as described above, there is a difference in improving effect on the high-temperature oxidation resistance property depending on a form around the interface between the antioxidant film and the substrate. Studies conducted by the present inventors revealed that observation of a cross-section of the antioxidant film at any position showed presence of very small pores (voids) around the interface between the antioxidant film and the substrate. The pore here is a very small void having an area of 0.5 $\mu m^2$ or less. In addition, the pore around the interface is a pore present in the material of at least one of the substrate and the antioxidant film around the boundary line between the substrate and the antioxidant film.

The pore around the interface between the antioxidant film and the substrate may be formed by slight oxidation and volatilization of Ir in the substrate in the process of oxidizing the Ni film. Formation of pores is considered to be influenced by factors such as the denseness and the crystal grain size of the Ni film, and various factors such as adhesion between the Ni film and the substrate. If a large amount of pores are present in the antioxidant film formed on Ni oxide, the oxygen blocking effect of the antioxidant film is reduced, so that the high-temperature oxidation resistance property is affected.

The results of studies conducted by the present inventors revealed that the total area of pores with respect to the length of the interface was preferably 5.0 $\mu m^2/\mu m$ or less for maintaining the oxidation resistance property at a high level. If the total area of pores is more than 5.0 $\mu m^2/\mu m$, even a film formed of Ni oxide has a poor effect. The total area of pores with respect to the length of the interface is more preferably 3.0 $\mu m^2/\mu m$ or less.

Presence of pores in the presence of the interface between the antioxidant film and the substrate can be confirmed by observing a cross-section of the antioxidant film at any position of the spark plug electrode material. The area can be measured on the basis of an image formed during observation of a cross-section. Here, appropriate image analysis software may be used. Preferably, a plurality of cross-sections are observed, and an average value is determined. The purpose for determining the total area of pores on the basis of the length of the interface is to give consideration to variations in pore size and distribution among observation positions.

(C) Underlying Layer

In the present invention, an underlying layer formed of Au is formed on the substrate during formation of the antioxidant film on the substrate surface. The underlying layer is set for preventing the Ni oxide film from peeling from the substrate in a heat treatment for forming a Ni film into a Ni oxide film and in a high-temperature atmosphere during engine operation. The reason why Au is used for the underlying layer is that Au has good adhesion with Ir, and does not react (dissolve) with Ir in the substrate in the heat treatment process for formation of the Ni oxide film. For the underlying layer, pure Au having a purity of 99.9 mass % or more can be applied.

The thickness of the underlying layer is preferably 0.05 μm or more and 0.1 μm or less. If the thickness of the underlying layer is less than 0.05 μm, the effect as an underlying layer cannot be expected. Even if the underlying layer is formed with a thickness of more than 0.1 μm, there is no change in action of the underlying layer. Since the underlying layer does not function as an antioxidant film, formation of the underlying layer with an excessively large thickness is not beneficial.

(D) Shape and Size of Spark Plug Electrode Material

The shape and the size of the spark plug electrode material according to the present invention are not particularly limited. Typically, the spark plug electrode material is used in the form of a chip-shaped material with a small size, and has a disc shape or a cylindrical shape. In many cases, the material has a diameter of 0.4 mm or more and 2.0 mm or less like a common spark plug electrode material. In many cases, the length is 0.5 mm to 2.0 mm.

The spark plug electrode material according to the present invention may have a larger length over the above-described size for producing the chip-shaped member. Here, the material has a wire shape with a length of 1 m or more.

(E) Method for Producing Spark Plug Electrode Material of Invention

Next, a method for producing a spark plug electrode material according to the present invention will be described. As described above, the spark plug electrode material according to the present invention includes an underlying layer formed of Au or the like and an antioxidant film formed of Ni on a substrate formed of Ir or Ir alloy. Here, Ni as an antioxidant film is turned into Ni oxide with a suitable structure by heat treatment or under a usage environment which is a high-temperature oxidizing atmosphere. Studies conducted by the present inventors revealed that the method for producing a Ni film being an antioxidant film was preferably based on a plating method in order to form Ni oxide with a suitable structure.

That is, the method for producing a spark plug electrode material according to the present invention includes the steps of: forming an underlying layer formed of Au on a substrate formed of Ir or Ir alloy; and forming an antioxidant film on a substrate formed on the underlying layer. The step of forming an antioxidant film includes performing Ni plating. Hereinafter, these steps will be described.

For the substrate formed of Ir or Ir alloy, a material with a shape and a size which are suitable for use as a spark plug electrode material. As described above, a chip-shaped small piece material is widely used as a spark plug electrode material, and therefore Ir or Ir alloy with a shape and a size suitable for this purpose may be used as a substrate.

However, it is convenient and preferable that Ir or Ir alloy in the form of a wire material is prepared as a substrate, and an underlying layer and an antioxidant film are formed on a surface of the substrate, and the substrate is then appropriately cut, rather than individually treating chip-shaped small piece materials as a substrate. When this wire material is used as a substrate, one wire-drawn to a necessary wire diameter for the spark plug electrode material may be used, or a wire material with a diameter lager than a necessary diameter may be prepared as a product, provided with an underlying layer and an antioxidant film, and then wire-drawn to a product diameter. Drawing may be performed before formation of the underlying layer. Drawing is performed before formation of the underlying layer, hot processing at 700° C. or higher and 1100° C. or lower is preferable. It is preferable that the wire material before formation of the underlying layer is appropriately subjected to degreasing treatment and washing treatment.

The substrate prepared as described above is first covered with an underlying layer formed of Au. The method for forming an underlying layer is not particularly limited as long as it is possible to form a film formed of Au, and a sputtering method, a plating method, a CVD method, vacuum deposition method or the like can be applied. In particular, a plating method is preferable from the viewpoint of deposition efficiency and ease of thickness adjustment. In particular, since the underlying layer is preferably one having a relatively small thickness as described above, strike plating treatment is preferable. The strike plating is plating treatment performed at a relatively high current density for a short time. Specifically, an underlying layer with a preferable thickness of 0.05 μm or more and 0.1 μm or less as described above can be formed by treatment at a current density of 3 ASD ($A/dm^2$) or more and 5 ASD ($A/dm^2$) or less for 10 seconds or more and 30 seconds or less. As a plating solution, a common gold plating solution can be used.

The substrate covered with the underlying layer is covered with a Ni film which is an antioxidant film. The method for forming a Ni film is a plating method as described above. This is because Ni oxide suitable as an antioxidant film is formed from the Ni film.

A preferred method for forming a Ni film by a plating method includes the step of performing Ni plating by use of a watt bath free of a primary gloss agent or a sulfamic acid bath free of a primary gloss agent as a plating solution is preferable. As a plating bath for Ni plating, several plating baths are known such as a watt bath with Ni sulfate as a main Ni source, a sulfamic acid bath with Ni sulfamate as a main Ni source, and a Wood bath with Ni chloride as a Ni source. Studies conducted by the present inventors revealed that the plating bath was preferably a watt bath or a sulfamic bath with the use of a plating solution free of a primary gloss agent. A Ni film formed by use of any of these plating solutions forms a Ni oxide film in the above-described suitable form when Ni turns into Ni oxide. When the Ni oxide film is provided, a more effective high-temperature oxidation property can be exhibited as a spark plug electrode material. Here, examples of the primary gloss agent in the nickel plating solution include aromatic sulfamic acid compounds such as benzenesulfonic acid and sodium naphthalenedisulfonate, sulfonimide compounds such as saccharin, and sulfur-containing compounds such as aromatic sulfonamide compounds. In the present invention, a watt bath or a sulfamic acid bath free of theses additives is preferable.

However, in the present invention, the additive which is restricted from being added to the plating solution is a primary gloss agent, and addition of a secondary gloss agent is not restricted. The plating solution may contain a secondary gloss agent as long as the shape and the property of the Ni film are not affected. Examples of the secondary gloss agent include unsaturated alcohols such as butynediol and propargyl alcohol.

As plating conditions, conditions enabling typical Ni plating can be applied. However, in the present invention, the antioxidant film is a Ni film having a thickness of 3.0 μm or more and 8.0 μm or less, and in the plating step, electric conditions such as current density and the plating time are adjusted so that the thickness of the Ni film formed is in the above-mentioned range.

Through the above steps, a spark plug electrode material can be produced in which an underlying layer and an antioxidant film are formed on a substrate. When a wire material is used as a substrate, chip-shaped spark plug electrode materials can be obtained by appropriately cutting the substrate. One or two-pass hot drawing may be performed for the wire material to have a product diameter after formation of the Ni film.

The Ni film which is an antioxidant film for the spark plug electrode material according to the present invention exhibits a substrate protecting action when oxidized into Ni oxide. The Ni oxide can be formed by exposing to a typical use environment a spark plug electrode material provided with a Ni film and produced as described above. However, after formation of the Ni film, the Ni film may be formed into a Ni oxide film by performing heat treatment in advance.

When the Ni film is formed into a Ni oxide film by heat treatment, it is preferable to perform heat treatment in an oxidizing atmosphere at a temperature of 500° C. or higher and 1000° C. or lower as the conditions. This is because oxidation reaction does not take place if the heat treatment temperature is lower than 500° C., and the substrate may be oxidation-consumed if the heat treatment temperature is higher than 1000° C.

The spark plug electrode material described above is mounted on the tip portion of each electrode to serve as a constituent member of a center electrode or an earth electrode of a spark plug.

Advantageous Effects of the Invention

The spark plug electrode material according to the present invention contains Ir or Ir alloy as a main component, and exhibits an excellent high-temperature oxidation property in a harsh environment. This is because an antioxidant film formed of Ni turns into Ni oxide, so that oxidation of Ir is suppressed to reduce the volatilization loss of Ir.

BRIEF DESCRIPTION OF THE DRAWINGS

The Figure shows SEM photographs of regions around the interface between an Ir alloy wire material substrate produced in a fourth embodiment and a Ni oxide film.

DESCRIPTION OF EMBODIMENTS

First embodiment: Hereinafter, preferred examples of the present invention will be described. This embodiment is a preliminary study for determining whether an underlying layer is required in formation of a Ni oxide film on an Ir alloy wire material. Here, a wire material (wire diameter: φ0.66 mm) which is an Ir—Ru alloy wire material (Ru: 20 mass %) was prepared, and the substrate was sequentially plated with Au and Ni. Au was deposited with a thickness of 0.05 μm by strike plating (conditions: current density: 4 ASD (A/dm$^2$), 20 seconds). Next, Ni was deposited with a thickness of 0.05 μm by strike plating (conditions: current density: 5.0 ASD, 60 seconds). This wire material was heated at 450° C. for 30 seconds.

On the other hand, the same Ir alloy wire material was directly plated with Ni as a reference example for examples. This wire material was heated at 450° C. for 30 seconds.

The heated wire material was cut, and a cross-section was observed. The result showed that a wire material having a Au underlying layer as an example was in a good adhesion state at both the Ir alloy wire material/Au underlying layer interface and the Au underlying layer Ni oxide film interface. On the other hand, a wire material having no Au underlying layer as a reference example had a gap at the Ir alloy wire material/Ni oxide film interface. The result of the preliminary studies revealed that it was necessary to add a Au underlying layer for forming a Ni oxide film.

Second embodiment: In this embodiment, an underlying layer (Au) and an antioxidant film (Ni) were formed on an Ir alloy wire material (substrate) to produce a spark plug electrode material. For comparison, a film of a metal other than Ni was formed as an antioxidant film, and the high-temperature oxidation property of the film was examined.

In the process for producing a spark plug electrode material in this embodiment, a wire material (wire diameter: φ0.66 mm) which is an Ir—Ru alloy wire material (Ru: 20 mass %) was prepared, degreased and washed, and then subjected to Au strike plating. Au plating was performed with a thickness of 0.05 μm (conditions: current density: 4 ASD (A/dm$^2$), 20 seconds). After the Au plating, the wire material was rinsed and degreased.

Next, Ni was deposited as an antioxidant film. For the Ni plating, a commercially available Ni watt bath free of gloss agents (primary gloss agent and secondary gloss agent) was used, and as plating conditions, the current density was 2.0 ASD, the time was 600 seconds, and the thickness was 4.0 μm. After the plating treatment, the material was rinsed, and subjected to hot drawing (900° C.) to set the wire diameter to φ0.60 mm. The wire material produced in this way was cut to a chip shape with a length of 0.80 mm to obtain a spark plug electrode material.

In this embodiment, samples plated with Pt, Rh and Pd were produced with regard to metal species of the antioxidant film of the spark plug electrode material. In the Pt, Rh and Pd plating steps, commercially available precious metal plating solutions (Pt: PLATANEX SF, Rh: RHODEX and Pd: PALLADEX 110 each produced by Electroplating Engineers Of Japan Ltd.) were used. As in the case of the Ni-plated sample, the material was plated to a thickness of 4 μm to obtain a chip-shaped electrode material with a length of 0.80 mm.

[Evaluation of High-Temperature Oxidation Resistance Property]

The high-temperature oxidation consumption of the spark plug electrode material produced as described above was evaluated. In this evaluation method, the produced sample was heated in the air at 1150° C. for 100 hours, and the consumption ratio was calculated from the weight measured before and after the test. The results are shown in Table 1. Further, this high-temperature test was conducted for a spark plug electrode material in which an Ir alloy wire material having no antioxidant film was formed into a chip shape.

TABLE 1

| Antioxidant film | Film thickness (μm) | Consumption ratio (%) | Class |
|---|---|---|---|
| None | — | 20.3 | Comparative Example |
| Ni | 4 | 9.7 | Example |
| Pt | | 35.6 | Comparative Example |
| Rh | | 12.5 | |
| Pd | | 42.1 | |

As is apparent from Table 1, a chip material formed of Ir alloy free of an antioxidant film had an oxidation consumption ratio of more than 20%. A spark plug electrode material with Ni formed as an antioxidant film had an oxidation consumption ratio of 9.7%, i.e. less than half the oxidation consumption ratio in Comparative Example with no antioxidant film, and had an effect of reduction by about 58%.

Materials with precious metal films of Pt, Rh and Pd formed as antioxidant films were tested, and the results showed that in any of the materials, a high-temperature oxidation resistance property improving effect as in the case of Ni was not exhibited. Although the reason why such a difference arises as compared to the effect of Ni is not evident, and it is considered that Ni is oxidized in a high-temperature oxidation atmosphere to turn into Ni oxide, leading to exhibition of an oxygen diffusion suppressing effect. In this respect, Pt or the like is a precious metal having a high high-temperature oxidation resistance property in itself, but is poor in function as a protective layer which suppresses oxygen diffusion when formed into film. This result revealed that a Ni film was suitable as a metal film as an antioxidant film.

Third embodiment: A spark plug electrode material was produced by forming a Au underlying layer and a Ni film on a substrate formed of the same Ir alloy wire material as in the second embodiment. In this embodiment, a plurality of materials were produced in which the thickness of a Ni oxide film as an antioxidant film was adjusted.

The Ni film as an antioxidant film was formed under the same conditions as in the second embodiment, and the thickness of the film was adjusted by adjusting the plating time. A high-temperature oxidation test was conducted by the same method as in the second embodiment, and a relationship between the thickness of the Ni film and the high-temperature oxidation property was examined. The results are shown in Table 2. In the high-temperature oxidation test, materials having an effect of reduction of the consumption ratio by 40% or more (consumption ratio: 12.0% or less) over the consumption ratio of materials free of a Ni film (about 20%) were rated acceptable, and distinction was made between examples and comparative examples.

TABLE 2

| No. | Antioxidant film | Thickness of Ni film (μm) | Consumption ratio (%) | Class |
|---|---|---|---|---|
| A1 | Ni | — | 20.3 | Comparative |
| A2 | | 0.2 | 17.1 | Example |
| A3 | | 1 | 16.8 | |
| A4 | | 2 | 13.2 | |
| A5 | | 4 | 9.7 | Example |
| A6 | | 8 | 10.6 | |

As is apparent from Table 2, a Ni film which is an antioxidant film exhibits a consumption ratio reducing effect even when the thickness of the film has 0.2 μm (No. A2), but the effect is still low. Referring to the consumption ratio of material No. A5 having an antioxidant film with a thickness of 4 μm (the second embodiment), the consumption ratio reducing effect will become significantly high from around 3 μm.

Fourth embodiment: In this embodiment, spark plug electrode materials were produced by forming Ni films with the use of a plurality of plating solutions. A relationship between the protection performance and the state of pores at the interface between the Ni oxide film and the substrate after high temperature oxidation.

In this embodiment, the following plating solutions A to E were used as Ni plating solutions. Among these plating solutions, solutions containing a primary gloss agent and/or secondary gloss agent appropriately contain the above-described compounds. In addition, when a pit inhibitor was added, an anionic surfactant such as sodium lauryl sulfate was added. As the following plating solution E, a plating solution containing the secondary gloss agent in an amount of 0.5 parts to 10 parts based on the amount (1 part) of a commercially available secondary gloss agent.

Plating solution A: Ni watt bath (nickel sulfate: 350 g/L, nickel chloride: 45 g/L and boric acid: 30 g/L) Plating solution free from gloss agent and pit inhibitor Plating solution B: Plating solution obtained by adding a gloss agent (primary and secondary) and a pit inhibitor to plating solution A (Ni watt bath)

Plating solution C: Commercially available Ni sulfamate-based plating solution (trade name: SULFAMEX (produced by Electroplating Engineers Of Japan Ltd.), plating solution free of a gloss agent and a pit inhibitor Plating solution D: Commercially available Ni sulfamate-based plating solution (trade name: MF-Ni100 (produced by Electroplating Engineers Of Japan Ltd.), gloss agent-free plating solution containing only a pit inhibitor Plating solution E: Commercially available Ni sulfamate-based plating solution (trade name: MF-Ni200 (produced by Electroplating Engineers Of Japan Ltd.), primary gloss agent-free plating solution containing a secondary gloss agent and a pit inhibitor In this embodiment, the same wire material as in the first embodiment was used as Ir alloy which is a substrate. As plating conditions for formation of Ni films from various plating solutions as described above, plating was performed at a current density of 2.0 ASD ($A/dm^2$) for 750 seconds. After formation of the Ni film, the wire material was formed into a chipped test piece as in the first embodiment.

Next, each test piece was heat-treated in the air at 900° C. for 1 hour to oxidize the Ni film into Ni oxide. Cross-sectional structures around the interface between the Ni oxide film and the substrate were observed to examine the state of pores around the interface. The Figure shows SEM photographs of regions around the interface in Ni oxide films obtained by heat-treating Ni films formed from plating solutions A and B. It is apparent that in each test piece, very small pores are formed on the Ni oxide or substrate side. This observation result shows that the number of pores is small in Ni (Ni oxide) formed from plating solution A (Ni watt bath, free of additives). The Ni oxide film did not peel in any of the test pieces.

In this embodiment, observation of cross-sectional structures as described above was performed at four positions, photographs of these cross-sectional structures were taken (magnification: 5000 times), and image analysis was performed to measure the number and the areas of pores. The image analysis was performed with software (Leica Application Suite produced by Leica). Gaps having an area of 0.5 $\mu m^2$ or less were detected as pores, marked and extracted, and the number and the areas of individual pores were calculated. The total value of the areas of pores (value obtained by division by the length of the interface of the observed region) was determined. This operation was performed at four observation regions, and an average of the obtained values was calculated.

A high-temperature oxidation test was conducted for each test piece after formation of the Ni oxide film. In this embodiment, each test piece was heated in the air at 1200° C. for 20 hours, and the consumption ratio was calculated from the weight measured before and after the test. The results of the high-temperature oxidation test are shown in Table 3.

TABLE 3

| No. | Plating solution: Designation | Plating solution: Basic configuration | Additives: Primary gloss agent | Additives: Secondary gloss agent | Additives: Pit inhibitor | Thickness of Ni film (μm) | Pore: Total area ($\mu m^2/\mu m$) | Pore: Number (number/μm) | Consumption ratio (%) |
|---|---|---|---|---|---|---|---|---|---|
| B1 | Plating solution A | Ni watt bath (Ni sulfate + Ni chloride) | — | — | — | 5.3 | 0.8 | 2.7 | 9.2 |
| B2 | Plating solution B | | Present | Present | Present | 3.7 | 5.9 | 10.2 | 11.8 |
| B3 | | | Present | Present | Present | 1.8 | 2.2 | 3.2 | 13.9 |
| B4 | Plating solution C | Ni sulfamate | — | — | — | 5.2 | 1.3 | 3.5 | 9.3 |
| B5 | Plating solution D | | — | — | Present | 4.7 | 4.9 | 9.9 | 9.8 |
| B6 | Plating solution E | | — | 0.5 parts | Present | 5.3 | 3.3 | 6.8 | 9.2 |
| B7 | | | — | 1 part | Present | 5.3 | 2.7 | 8.3 | 9.5 |
| B8 | | | — | 2 parts | Present | 5.3 | 2.0 | 5.7 | 9.1 |
| B9 | | | — | 5 parts | Present | 5.4 | 2.3 | 6.3 | 9.6 |
| B10 | | | — | 10 parts | Present | 5.0 | 4.3 | 9.5 | 9.5 |
| B11 | | | — | | | — | — | | 14.8 |

It is apparent from Table 3 that with respect to the oxidation consumption ratio of Ir alloy free of a Ni film, a consumption ratio reducing effect is obtained even if the thickness of the Ni film is small as in the case of the third embodiment. However, since the consumption ratio of a Ni film with a thickness of 1.8 μm is relatively high (No. B3), a Ni film with a thickness of 3 μm or more is needed.

From the viewpoint of the state of pores at the interface between the Ni oxide film and the substrate, the total area of pores is preferably low for further enhancing the oxidation consumption suppressing effect. Even when the Ni film had a thickness of more than 3 μm, the consumption ratio was relatively high as long as the total area of pores was more than 5.0 $\mu m^2/\mu m$ (No. B2).

For the state of pores after oxidation into Ni oxide, the material having a Ni film formed from the plating solution A (Ni watt bath, without additives) has an extremely small total area of pores (based on the length of the interface), and a particularly low consumption ratio (No. B1). For any of the materials in which the total area of pores is 5.0 $\mu m^2/\mu m$ or less, the plating solution does not contain a primary gloss agent, and therefore it may be preferable to eliminate the primary gloss agent from the plating solution for formation of a Ni film for the spark plug electrode material of the present invention. However, it is considered that the protection property of the Ni film does not vary depending on the existence or non-existence and the concentration of the secondary gloss agent.

INDUSTRIAL APPLICABILITY

The present invention provides a plug electrode material which is excellent in high-temperature oxidation resistance property and which can be used for a long period of time. The present invention is applicable to plugs which are used for automobile engines brought into a harsher environment by improvement of fuel efficiency or the like.

The invention claimed is:

1. A material for use in a spark plug electrode comprising:
a substrate formed of Ir or Ir alloy;
an underlying layer formed of Au on a surface of the substrate; and
an antioxidant film formed on the underlying layer, the antioxidant film being a Ni film having a thickness of 3.0 μm or more and 8.0 μm or less.

2. The spark plug electrode material according to claim 1, wherein the antioxidant film becomes Ni oxide when heated in an oxidizing atmosphere at 500° C. or higher.

3. The spark plug electrode material according to claim 2, wherein a thickness of the underlying layer is 0.05 μm or more and 0.1 μm or less.

4. The spark plug electrode material according to claim 2, wherein
the substrate is formed of Ir alloy, and
the Ir alloy is an alloy of Ir and at least one metal of Rh, Pt, Ru, Ni, W, V and Cr.

5. The spark plug electrode material according to claim 2, wherein
pores are present at an interface between the antioxidant film and the substrate when a cross-section of the antioxidant film is observed, and
a total area of the pores with respect to a length of the interface is 5.0 $\mu m^2/\mu m$ or less.

6. The spark plug electrode material according to claim 5, wherein a thickness of the underlying layer is 0.05 μm or more and 0.1 μm or less.

7. The spark plug electrode material according to claim 5, wherein
the substrate is formed of Ir alloy, and
the Ir alloy is an alloy of Ir and at least one metal of Rh, Pt, Ru, Ni, W, V and Cr.

8. The spark plug electrode material according to claim 5, wherein the number of pores with respect to the length of the interface is 10 pieces/μm or less.

9. The spark plug electrode material according to claim 8, wherein a thickness of the underlying layer is 0.05 μm or more and 0.1 μm or less.

10. The spark plug electrode material according to claim 1, wherein a thickness of the underlying layer is 0.05 μm or more and 0.1 μm or less.

11. The spark plug electrode material according to claim 1, wherein
the substrate is formed of Ir alloy, and
the Ir alloy is an alloy of Ir and at least one metal of Rh, Pt, Ru, Ni, W, V and Cr.

12. A spark plug comprising the spark plug electrode material defined in claim 1.

13. A method for producing a spark plug electrode material as defined in claim 1, comprising the steps of:

forming an underlying layer formed of Au on a substrate formed of Ir or Ir alloy; and forming an antioxidant film on a substrate formed on the underlying layer, wherein the step of forming the antioxidant film is Ni plating.

14. The method for producing a spark plug electrode material according to claim 13, wherein the step of forming an antioxidant film is performing Ni plating by use of a watt bath free of a primary gloss agent or a sulfamic acid bath free of a primary gloss agent as a plating solution.

15. The method for producing a spark plug electrode material according to claim 13, comprising the step of heating a substrate provided with an antioxidant film at a temperature of 500° C. or higher and 1000° C. or lower to form Ni as the antioxidant film into Ni oxide.

16. The method for producing a spark plug electrode material according to claim 13, wherein the step of covering an underlying layer formed of Au on the substrate includes performing strike plating treatment.

17. A spark plug electrode material comprising: a substrate formed of Ir or Ir alloy;

an underlying layer formed of Au on a surface of the substrate, and an antioxidant film formed on the underlying layer opposite the substrate, the antioxidant film being a Ni oxide film having a thickness of 3.0 μm or more and 8.0 μm or less.

18. The spark plug electrode material according to claim 17, wherein the antioxidant film is formed of Ni oxide, pores are present at an interface between the antioxidant film and the substrate when a cross-section of the antioxidant film is observed, and a total area of the pores with respect to a length of the interface is 5.0 μm2/μm or less.

19. The spark plug electrode material according to claim 17, wherein a thickness of the underlying layer is 0.05 μm or more and 0.1 μm or less.

20. The spark plug electrode material according to claim 17, wherein the substrate is formed of Ir alloy, and the Ir alloy is an alloy of Ir and at least one metal of Rh, Pt, Ru, Ni, W, V and Cr.

* * * * *